United States Patent [19]

Keller et al.

[11] 4,367,827

[45] Jan. 11, 1983

[54] ANTITHEFT MECHANISM FOR GASOLINE PUMP

[75] Inventors: Gerald H. Keller, Palos Heights; Frank J. Senese, Hickory Hills; John G. Vlasic, South Holland, all of Ill.

[73] Assignee: Atlantic Richfield Company, Philadelphia, Pa.

[21] Appl. No.: 214,186

[22] Filed: Dec. 8, 1980

[51] Int. Cl.[3] ..... B67D 5/10

[52] U.S. Cl. ..... 222/2; 222/23; 222/52; 222/153; 307/115; 361/189; 70/389; 194/5; 194/13

[58] Field of Search ..... 222/153, 23, 52, 76, 222/2; 307/115, 116, 139, 140, 142; 70/389; 361/189; 340/568, 542; 194/4 R, 4 C, 4 G, 13, 5

[56] References Cited

U.S. PATENT DOCUMENTS

| | | | |
|---|---|---|---|
| 2,807,007 | 9/1957 | Meservey | 222/23 |
| 3,187,939 | 6/1965 | Hayes | 222/76 |
| 3,632,988 | 1/1972 | Yamawaki et al. | 194/5 |
| 3,708,032 | 1/1973 | Suzuki | 70/389 |
| 3,779,357 | 12/1973 | Haller et al. | 222/153 |

*Primary Examiner*—H. Grant Skaggs

*Attorney, Agent, or Firm*—Stanley M. Welsh

[57] ABSTRACT

An improved self-service gasoline pump is designed to insure payment for the fuel which has been delivered by the pump. The pump includes a switch mechanism which must be operated by the ignition key of an automobile prior to operation of the pump. Upon insertion of the ignition key into the switch mechanism, the mechanism automatically clamps and retains the key until the key is released by operation of a remote switch at the cash collection station. The switch mechanism includes a key actuated switch in the key slot. Upon actuation of the switch, a fuel pump circuit is closed and a solenoid locking circuit is also closed which causes the key to be clamped. A remote unlocking switch may be operated to release the solenoid locking circuit.

7 Claims, 7 Drawing Figures

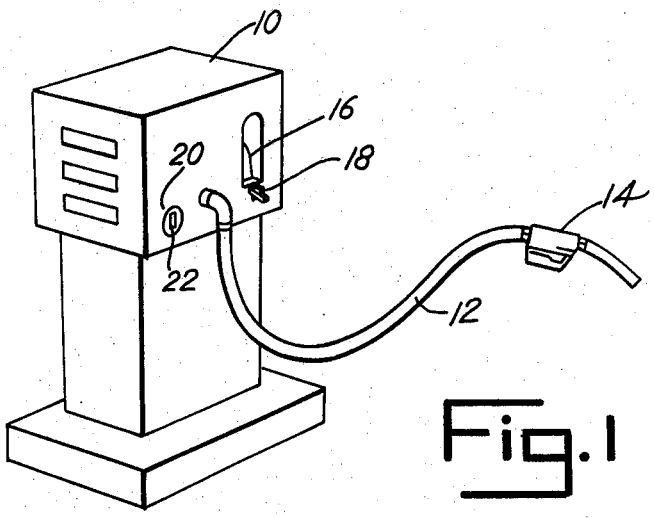
Fig. 1
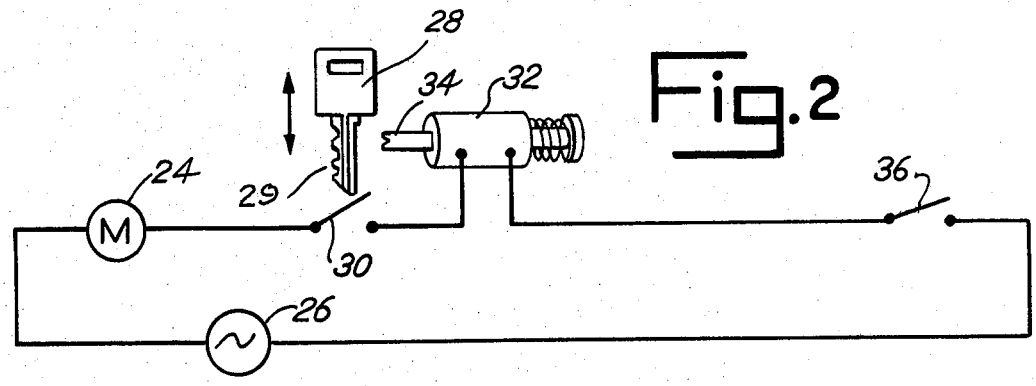
Fig. 2
Fig. 3
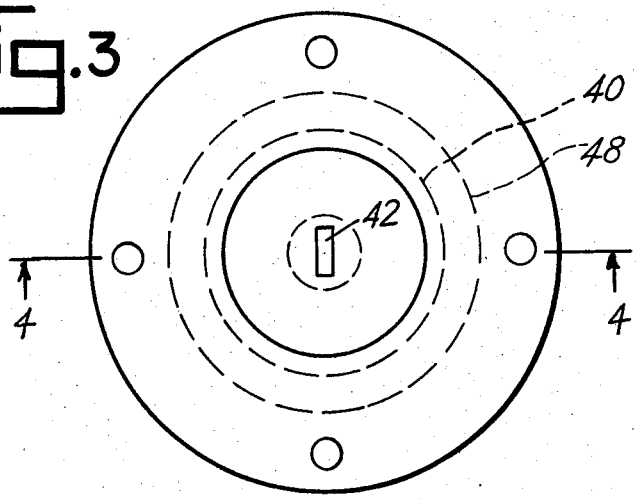

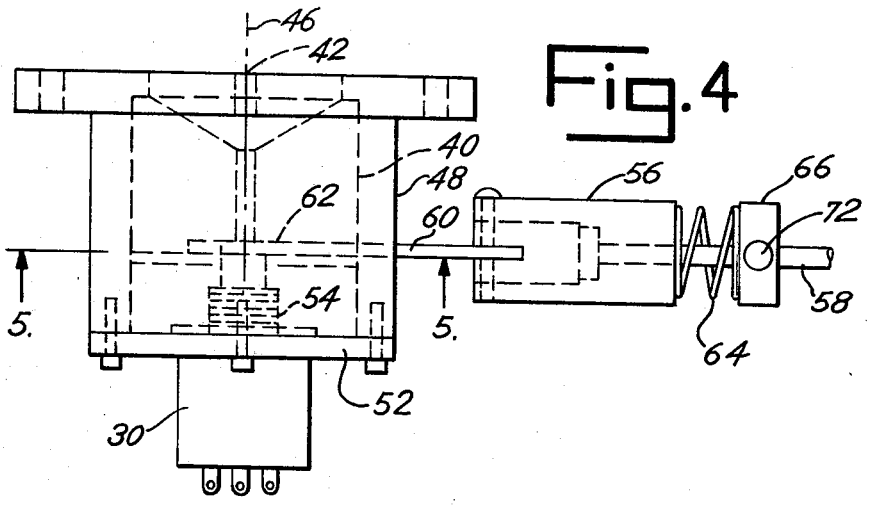
Fig. 4
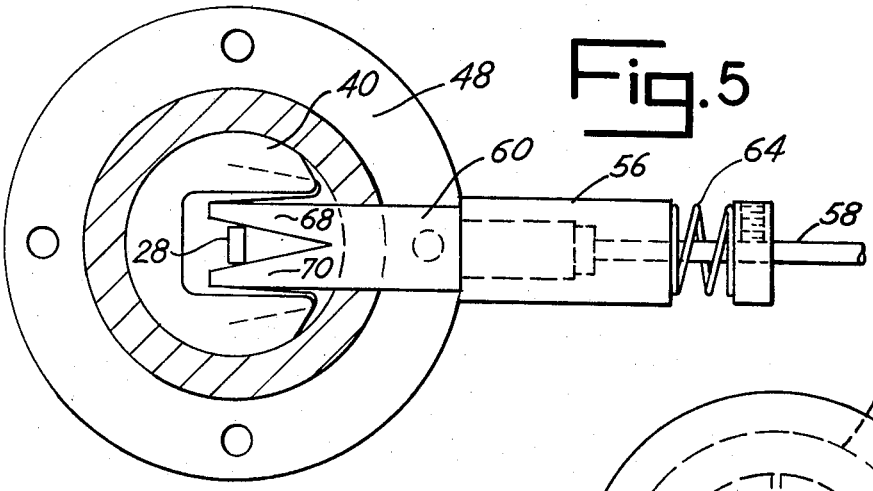
Fig. 5
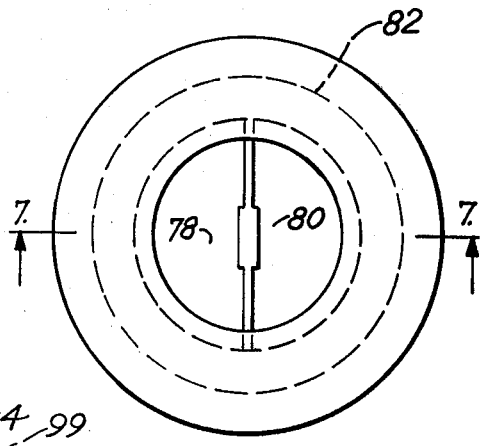
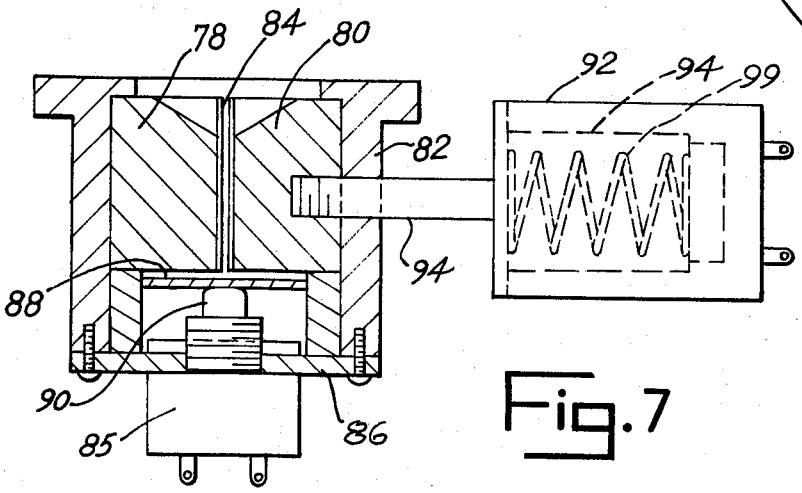
Fig. 6
Fig. 7

ANTITHEFT MECHANISM FOR GASOLINE PUMP

BACKGROUND OF THE INVENTION

This invention relates to improved self-service fuel pump equipment particularly the type used to dispense gasoline at a self-service station.

Many gasoline service stations now permit the customer to fill a gas tank using the station fuel pump. A problem that has resulted is that some customers fill their tank and then drive away without paying for the fuel. One way to overcome this problem is to require the customer to prepay for the fuel which he proposes to buy. This, however, has been found to slow or delay traffic in a self-service gasoline station. Additionally, once the prepayment is made and the pump is unlocked so that the customer may use it, the customer may pump more than the amount of gasoline for which he paid.

Another solution is the use of gates or restraining devices to control traffic through a service station. This is an expensive means of control. Various other sophisticated means of controlling the dispensing of fuel are possible. However, the cost of using such means is often not justified.

The present invention provides for a relatively inexpensive method for control of dispensing fuel from a self-service pump.

SUMMARY OF THE INVENTION

Briefly, the present invention comprises the improvement of security means in a self-service fuel pump apparatus for dispensing gasoline or other fuel. The security means includes an ignition key operated switch which the customer activates by insertion of his auto ignition key. Insertion of the key into the switch closes a set of contacts which, in turn, actuates a clamping mechanism against the key so that the key cannot be removed. Simultaneously a pump power circuit is closed permitting pump operation. A remote switch at the cash collection station may be actuated to release the clamping mechanism and open the pump power circuit once the customer has made payment for the fuel. Two embodiments of the mechanism for retention of the key are disclosed.

Thus, it is an object of the present invention to provide an improved antitheft mechanism for a self-service fuel dispensing apparatus.

It is a further object of the present invention to provide a mechanism for receipt and retention of an auto ignition key.

It is a further object of the present invention to provide an inexpensive mechanism for combination with a gasoline fuel pump that permits control of the operation of the fuel pump by means of a remote switch in combination with a switch located at the fuel pump and actuated by the customer.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a perspective view of a typical gasoline fuel pump apparatus which incorporates the improved security device of the present invention;

FIG. 2 is a schematic view and circuit diagram of the mechanism of the invention;

FIG. 3 is a front elevation of a first embodiment of the security device of the invention;

FIG. 4 is a cross sectional view substantially along the line 4—4 in FIG. 3;

FIG. 5 is a cross sectional view of the apparatus of FIG. 4 taken substantially along the line 5—5;

FIG. 6 is a front elevation of an alternative construction of the invention; and FIG. 7 is a cross sectional view of the embodiment of FIG. 6 taken substantially along the line 7—7.

DESCRIPTION OF THE PREFERRED EMBODIMENT

FIG. 1 illustrates a typical gasoline pump as used at a service station to dispense gasoline for automobiles and other vehicles. The pump 10 generally includes a hose 12 with a nozzle 14. The nozzle 14 normally rests in a nozzle support bracket 16. To effect operation of the pump 10, a pump switch 18 which is attached at the lower part of the bracket 16 is manually rotated to provide power to a fuel pump motor for pumping gasoline through the hose 12.

The device of the present invention is used in combination with a pump 10 of the type illustrated in FIG. 1 and is especially useful in association with self-service pumps. Typically self-service pumps are as described above and also include a set of directions so that a customer may understand and operate the pump. Usually, after filling the tank of a vehicle, the customer will return the hose 12 to the bracket 16 and pay for the gasoline at the cash station or service counter. However, with the increase in the cost of gasoline, some customers will fill their tank with gasoline and neglect to pay.

To overcome this problem, the present invention contemplates an antitheft or security device 20 which is incorporated in pump 10. The security device 20 includes a slot 22 for receipt of an ignition key of the customer. Location of the security device preferably will permit the attendant to observe that a key was in fact used by the customer. In order to effect operation of the pump 10, therefore, the customer needs to insert his automobile ignition key into the slot 22. This will permit operation of the pump 10. Simultaneous with insertion of a key into the slot 22, a clamping mechanism associated with the security device 20 will grip and retain the key. The ignition key will then be retained in the slot 22 until the station operator operates a switch to release the key. This is done after the customer pays for the gasoline.

FIG. 2 is a schematic diagram illustrating the arrangement of the circuit which controls a motor 24 for the pump 10. Thus, referring to FIG. 2, a motor 24 is supplied by a power source 26. The circuit supplying electricity to the motor 24 passes through the security device 20. A key 28 fits through the slot 22 so that it may engage a contact switch 30. This closes a circuit through the solenoid 32 activating a locking member 34 to retain the key 28 in position. A remote switch 36 manually operable is usually in the closed position.

Thus, the motor 24 may be operated to deliver gasoline through the hose 12. Once the motor 24 is no longer needed, the customer pays for the gasoline purchased and the remote switch 36 is opened. This releases power through the solenoid 32 which, in turn, releases the clamp 34 so that the key 28 may be removed and the switch 30 opened. Subsequent to removal of the key, the manual switch 36 is again closed, thereby completing a cycle. The cycle may be repeated for each subsequent customer.

FIGS. 3, 4 and 5 illustrate a first preferred embodiment of the security device 20. FIGS. 6 and 7 illustrate an alternative embodiment.

Referring therefore to FIGS. 3, 4 and 5, the security device includes a barrel 40 having an axial slot 42. The barrel 40 includes a center line axis 46 which is co-axial with the slot 42. The barrel 40 is generally cylindrical and the axial length of the slot 42 is sufficient to receive and orient the key 28 in a generally rigid position within the slot 22. The barrel 40 is mounted in a housing 48 which may be affixed to the pump 10 as depicted in FIG. 1. A switch 30 is attached to a back plate 52 mounted on the housing 48 in axial alignment with slot 42. Switch 30 includes a contact actuator 54 for cooperation with key 28 inserted into the slot 22. Since the switch 30 is normally open and is positioned at the extreme end of slot 22, a key 28 must be fully inserted into slot 22 before pump actuation is possible. This arrangement tends to foil use of devices other than keys and also tends to insure total insertion and retention of a key by the mechanism.

A solenoid housing 56 is attached to the main housing 48 in spaced relation therefrom. A solenoid plunger or rod 58 is maintained in the housing 56 movable in response to passage of current through a solenoid coil in housing 56. The plunger 58 is connected with a key engaging member or ratchet 60 which projects through a slot 62 in the barrel 40 and housing 48. Provided that manual switch 36 is closed, actuation of the switch 30 allows current to pass through the solenoid coil actuating the ratchet 60 and driving it into engagement with key 28 positioned in the slot 22. Note that the solenoid rod 58 is actuated in opposition to the force of spring 64 interposed between a fixed stop ring 66 attached to the solenoid rod 58 and housing 56.

The ratchet or member 60 includes bifurcated arms 68 and 70 which are adapted to engage in a bit 29 in FIG. 2 of key 28. The bit 29 of key 28 is that part of key 28 which enters a lock to engage a tumbler. The travel of the ratchet 60 may be adjusted by means of a set screw 72 in the ring 66.

FIGS. 6 and 7 illustrate an alternative embodiment of the security mechanism. Referring to those figures, a barrel is comprised of separate jaws 78 and 80 which are retained in a housing 82. The separate barrels 78 and 80 define a slot 84 for receipt of a key 28. A switch 85 is attached to a backplate 86 and retained in position for cooperation with a key 28 inserted in slot 84. The key 28 impinges upon a spacer plate 88 which, in turn, acts against the contact driver 90 of switch 85.

A solenoid housing 92 includes a solenoid actuated arm 94 which is responsive to passage of current through a coil in housing 92 to engage and drive jaw 80 and thereby clamp that jaw against a key 28 in slot 84. This action wedges the key 28 between jaws 78 and 80. A biasing spring 99 is provided for return of the solenoid arm 94 to its original position upon withdrawal of current through the solenoid coil.

Both of the described security devices operate to retain a key 28 in locked position in a pump 10 until a switch 36 is opened so as to release a solenoid. With the device of the present invention, it is possible to provide improved security with respect to a gasoline pump. It is also possible to vary the specific construction of the security device and its circuitry. Thus, the invention is to be limited only by the following claims and their equivalents.

What is claimed is:

1. In a pump apparatus for dispensing gasoline or other fuel, the improvement of security means to inhibit theft of fuel, said means including a remote control switch and also including a key operated relay connected in series with a power supply for the pump apparatus and the pump apparatus, said relay comprising, in combination:

a barrel having a slot for receipt of a key, said slot defining an axis;

a contact switch to be contacted by a key after insertion of that key into the slot;

a key gripping member aligned generally transverse to the axis and translatable in a passage in the barrel into and out of a position of engagement with the key positioned in the slot, said key gripping member comprising bifurcated arms projecting on opposite sides of the axis and slot for engagement with a bit of the key in the slot; and solenoid means attached to the key gripping member to drive the member into and out of engagement with the key in the slot, said solenoid means in series with the contact switch to effect operation of the solenoid means for movement to engage the key and also in series with said remote control switch for release of the solenoid means upon operation of the remote switch.

2. The improvement of claim 1 wherein said contact switch comprises a switch mechanism at one end of the slot in the barrel positioned on the axis for engagement only by a key fully inserted into the slot.

3. The improvement of claim 2 wherein the switch mechanism is normally open.

4. In a pump apparatus for dispensing gasoline or other fuel, the improvement of security means to inhibit theft of fuel comprising, in combination:

a key operated relay connected in series with a power supply for the fuel pump apparatus and the fuel pump apparatus, said relay including barrel means defining a slot for receiving a key and having an axis, a key gripping member aligned generally transverse to the axis and translatable into and out of a position of engagement with the key comprising separate jaw members, a contact switch located so as to be contacted by a key after insertion of that key into the slot, and a means for closing and opening the jaw members into engagement with a key in the slot, and a remote switch means in series with said contact switch for causing said means to open the jaw members from the key.

5. The improvement of claim 4 wherein the means for closing and opening the jaw members comprises a solenoid attached to at least one jaw member.

6. The improvement of claim 4 wherein said contact switch comprises a switch mechanism at one end of the slot in the barrel positioned on the axis for engagement only by a key fully inserted into the slot.

7. The improvement of claim 6 wherein the switch mechanism is normally open.

* * * * *